United States Patent [19]

Steiner

[11] Patent Number: 4,512,374

[45] Date of Patent: Apr. 23, 1985

[54] LAMELLAE COMB FOR WEAVING APPARATUS, PARTICULARLY FOR A WEAVING ROTOR IN A MULTIPLE LONGITUDINAL TRAVERSING SHED WEAVING LOOM, AND METHOD FOR MANUFACTURING THE SAME

[75] Inventor: Alois Steiner, Rieden, Switzerland

[73] Assignee: Maschinenfabrik Sulzer-Rüti AG, Rüti, Switzerland

[21] Appl. No.: 483,527

[22] Filed: Apr. 11, 1983

[30] Foreign Application Priority Data

Apr. 20, 1982 [CH] Switzerland ..... 2377/82

[51] Int. Cl.[3] ..... D03D 49/60; D03D 41/00; D03C 13/00

[52] U.S. Cl. ..... 139/191; 139/11; 139/28; 139/55.1

[58] Field of Search ..... 139/190, 191, 188 R, 139/28, 48, 11 A, 436, 55.1, 33

[56] References Cited

U.S. PATENT DOCUMENTS

| | | | |
|---|---|---|---|
| 2,893,440 | 7/1959 | Brusadelli | 139/55.1 |
| 3,848,642 | 11/1974 | Steiner | 139/11 A |
| 4,291,729 | 9/1981 | Steiner | 139/28 |

FOREIGN PATENT DOCUMENTS

| | | | |
|---|---|---|---|
| 2645302 | 12/1977 | Fed. Rep. of Germany | 139/11 A |
| 891218 | 11/1943 | France | 139/33 |
| 450500 | 7/1949 | Italy | 139/33 |
| 160321 | 3/1921 | United Kingdom | 139/55.1 |
| 440173 | 9/1934 | United Kingdom | 139/55.1 |
| 819974 | 9/1959 | United Kingdom | 139/11 A |
| 277634 | 12/1970 | U.S.S.R. | 139/11 A |

*Primary Examiner*—James Kee Chi

*Attorney, Agent, or Firm*—Werner W. Kleeman

[57] ABSTRACT

A lamellae comb comprises a carrier or support and lamellae or small plates arranged thereupon which contain lateral projections serving as shed-retaining elements for the warp threads. Each shed-retaining element is formed by a respective projection at the two lamellae enclosing the shed-retaining element. The projections protrude towards each other, conjointly bridge the intermediate space between the lamellae and are mutually offset in the warp direction. Thus, the tube width may be adjusted within wide limits without the lamellae containing the projections having to be exchanged. The lamellae are positioned on the carrier or support by means of racks resiliently supported at the carrier and extending over the weaving or fabric width. The teeth of the racks position the lamellae and have a tooth division or pitch corresponding to the desired tube width of the lamellae. Thus, the lamellae division or pitch does not exhibit any error across the entire weaving width, particularly no summation error, and the lamellae combs can be exactly reproduceably manufactured.

20 Claims, 3 Drawing Figures

LAMELLAE COMB FOR WEAVING APPARATUS, PARTICULARLY FOR A WEAVING ROTOR IN A MULTIPLE LONGITUDINAL TRAVERSING SHED WEAVING LOOM, AND METHOD FOR MANUFACTURING THE SAME

CROSS-REFERENCE TO RELATED APPLICATION

This application is related to my commonly assigned, copending U.S. application Ser. No. 483,526 filed Apr. 11, 1983, entitled "Multiple Longitudinal Traversing Shed Weaving Apparatus".

BACKGROUND OF THE INVENTION

The present invention relates to a new and improved lamellae comb for weaving apparatuses or looms, particularly for a weaving rotor in a multiple longitudinal traversing shed weaving machine or loom, and also pertains to a method of manufacturing the same. The lamellae comb for weaving looms according to the invention contains lamellae or small plates or the like arranged on a carrier or support and shed-retaining elements for the warp threads which are formed by lateral projections at the lamellae.

A lamellae comb of this general type has already been proposed, which may be rapidly and readily exchanged at the weaving rotor and which can be manufactured at a small expense and in a short amount of time. However, the lamellae comb is still relatively complicated to modify for adaptation thereof to changes in the lamellae pitch, i.e. in other words to changes in the warp density, due to a change in the article to be woven.

Since the shed-retaining elements for the warp threads must exactly bridge the intermediate space between adjacent lamellae, the so-called tube width, each change in the tube width requires that the lamellae provided with the shed-retaining elements be exchanged against others, the projections of which protrude exactly from the lamellae by the new tube width. Additionally, a complete set of lamellae must be acquired and stored for each tube width required for the spectrum of articles manufactured by the relevant weaving mill.

SUMMARY OF THE INVENTION

Therefore, with the foregoing in mind it is a primary object of the present invention to provide a new and improved lamellae comb for a weaving loom, particularly for a weaving rotor in a multiple longitudinal traversing shed weaving loom, which can be readily adapted to changing warp densities and thus to changing tube widths.

Another and more specific object of the present invention is directed to the provision of a new and improved lamellae comb for weaving looms, particularly for a weaving rotor in a multiple longitudinal traversing shed weaving loom, which can be readily adapted to changing warp densities and changing tube widths without requiring an exchange of the lamellae provided with shed-retaining elements.

It is also an important object of the present invention to provide a new and improved method of manufacturing such a lamellae comb for a weaving loom, particularly for a weaving rotor in a multiple longitudinal traversing shed weaving loom.

Another significant object of the present invention is directed to the provision of a new and improved method of manufacturing a lamellae comb for a weaving loom, particularly for a weaving rotor in a multiple longitudinal traversing shed weaving loom, in which method of manufacture summation errors no longer occur, so that the lamellae comb can be manufactured in a precisely reproduceable manner.

Now in order to implement these and still further objects of the invention, which will become more readily apparent as the description proceeds, the lamellae comb of the present development is manifested by the features that, each shed-retaining element is formed by a respective projection extending from the two lamellae which enclose the shed-retaining element, the projections protruding towards each other, conjointly bridging the intermediate space between the two lamellae and being mutually offset.

By designing the shed-retaining elements according to the invention in the form of two projections or extensions protruding towards each other and offset from each other, the tube width can be infinitely or continuously adjusted to any desired value between a value corresponding to the height of one of the projections and to a value corresponding to the sum of the heights of the two projections. In the first case the two projections will completely overlap and in the latter case the free end faces thereof will be in alignment with one another. When, for example, the height of each projection is 0.8 mm and two warp threads are present in each tube, a spectrum of articles having a range of about 20 to about 10 warp threads per centimeter can be covered by a single lamellae set. When the warp threads are drawn in at a lesser density, for example, with only one warp thread for each tube, then the spectrum of articles encompasses a range of 20 to 5 warp threads per centimeter.

As already alluded to above, the invention also relates to an improved method of manufacturing a lamellae comb for a weaving loom, particularly for a weaving rotor in a multiple longitudinal traversing shed weaving loom, wherein the lamellae or small plates are mounted on a carrier or support, positioned in accordance with the desired lamellae pitch and are subsequently fixed to the carrier.

Since on the weaving rotor of a multiple longitudinal traversing shed weaving loom there are always arranged a number of such lamellae combs, namely generally more than ten, these lamellae combs are required to be as identical as possible and, particularly, to have the same length. It is known, however, from the manufacture of reeds for single-phase weaving looms that such reeds in practice cannot be precisely reproduced, since the smallest error in the thickness of the wire which is used as a spacer element and the smallest irregularity of the teeth of the reed become effective as sum or summation errors. Therefore, even "identical" reeds of the usual width of about 180 cm display differences in the order of magnitude of millimeters.

The same problem exists in the lamellae combs of multiple longitudinal traversing shed weaving looms. However, in addition thereto it has been found that not even the most precise gauges are helpful in the manufacturing process, because the tube width of the heretofore known lamellae combs is established by the width of the shed-retaining elements. Therefore, the tube cannot be made narrower than the width of the shed-retaining elements, because this is prevented by the shed-retaining elements. Also, it will be self-evident that the tube cannot be made wider, since in such case the shed-retaining elements would no longer bridge the entire tube, so that it would be possible for the warp threads to slip through between the shed-retaining element and the adjacent lamella without the shed-retaining element.

With the lamellae comb constructed according to the invention each shed-retaining element is formed by two projections or extensions protruding towards each other, and thus, there is enabled for the first time manufacturing of a lamellae comb in which the tube width is not governed by the height of the shed-retaining elements.

As previously stated, with the manufacturing method of the invention for such a lamellae comb there is possible elimination of the summation error, and hence, the lamellae comb can be exactly reproduced each time.

In order to implement this object of the invention, the method of the present development is manifested by the features that, the lamellae are positioned on the carrier or support using a positioning element arranged in parallelism with the carrier. The positioning element is provided with guiding means for the lamellae, and the pitch or division of the guiding means corresponds to the desired pitch or division of the lamellae.

By using the aforementioned positioning element including the guiding means for the lamellae, the pitch of which corresponds to the desired lamellae pitch, there can be dispensed with the use of any kind of spacing elements arranged between the lamellae, so that the aforementioned sum or summation error is a priori excluded. In case that the positioning element is, for example, of a rod-like design and the guiding means are formed by grooves, then the error which at most can occur can only be due to the machine tool used for producing the grooves. However, such error would be negligibly small in any case. Additionally, such error would be the same for all the rod-like elements processed on the same machine tool, so that the elements, and thus, the lamellae combs would be exactly identical even in this most unfavorable case.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the lamellae comb has been shown as needed for those skilled in the art to readily understand the underlying principles and concepts of the present development, while simplifying the showing of the drawings. Turning attention now specifically to FIGS. 1 to 3, there has been schematically shown a lamellae comb for a weaving rotor of a multiple longitudinal traversing shed weaving machine or loom. The lamellae comb comprises a carrier or support 1, a beat-up comb 2 and a guide comb 3, the two combs 2, 3 being mutually offset by half a pitch or division with respect to one another. The construction and operation of a multiple longitudinal traversing shed weaving machine or loom containing a weaving rotor is properly assumed as being known to those skilled in the art and, therefore, is not here explained in any great detail; reference is, however, made in this regard to U.S. Pat. No. 4,291,729, granted Sept. 29, 1981. In that patent the mutual offset of the two lamellae combs 2, 3 by half a division or pitch is also extensively described.

Figure 3:
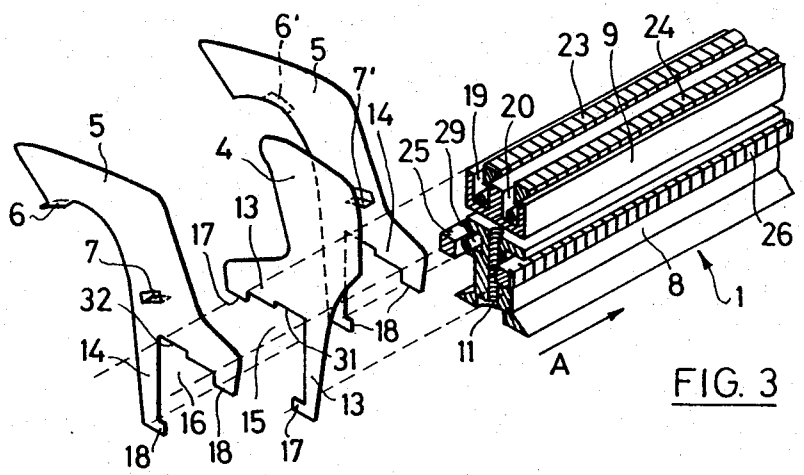
FIG. 3 is a schematic illustration in exploded perspective view of the carrier or support shown in FIG. 1 including three lamellae or small plates to be mounted thereon.
Figure 1:
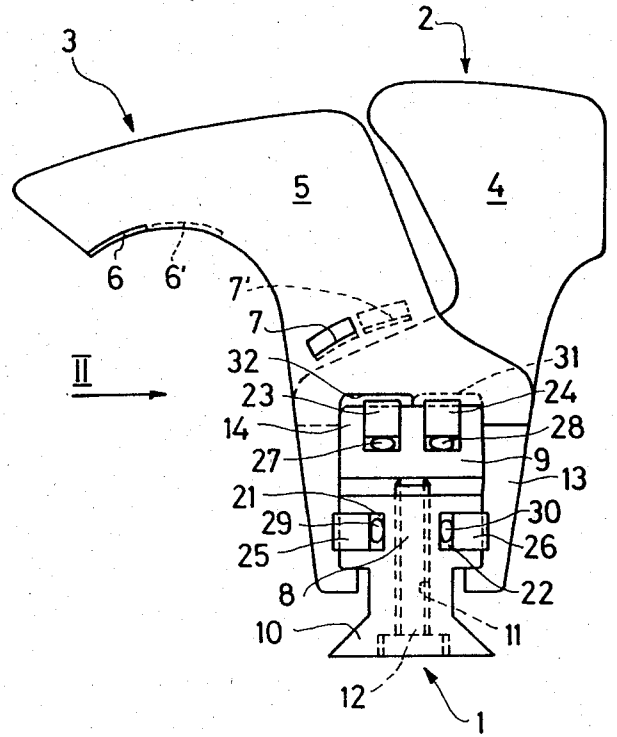
FIG. 1 is an end view, on an enlarged scale, of a carrier or support carrying two lamellae combs constructed according to the present invention.

In principle, any known weft insertion system can be used with a multiple longitudinal traversing shed weaving loom. The lamellae comb as shown in FIGS. 1 to 3 is not limited to a specific weft insertion system and is not specific for such a weft insertion system, and thus, there is no need to here consider such a weft insertion system.

According to the drawings, the beat-up comb 2 comprises beat-up lamellae or small plate members 4 serving to beat-up the weft threads, and the guide comb 3 comprises guide lamellae or small plate members 5 for the warp threads K. The guide lamellae or small plate members 5 are provided with shed-retaining elements which determine the upper shed position or lower shed position, respectively, of the warp threads K. By means of the shed-retaining elements the warp threads are retained over the entire wrap angle at the weaving rotor in their upper shed position or in their lower shed position, as the case may be.

Figure 2:
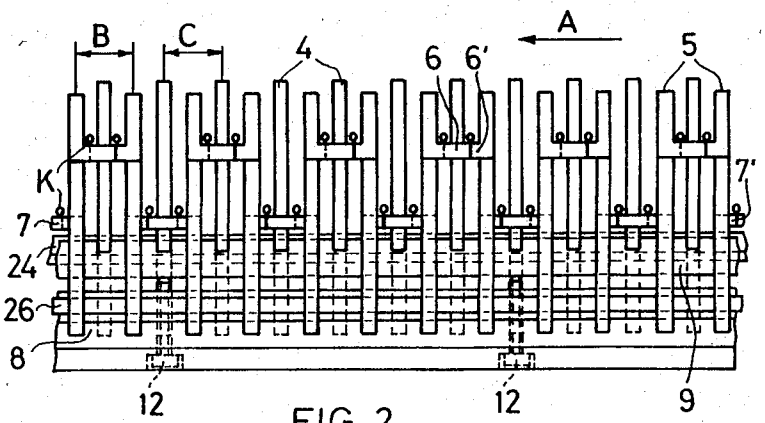
FIG. 2 is a view of the arrangement shown in FIG. 1 looking in the direction of the arrow II thereof.

FIG. 2 shows the individual lamellae 4, 5 illustrated exaggerated in thickness; the tube formed between two adjacent guide lamellae 5 is designated by reference character B, and the tube formed between two adjacent beat-up lamellae 4 is designated by reference character C. It will be seen that both of the lamellae combs 2 and 3 (see FIG. 1) containing the lamellae 4 and 5, respectively, are mutually offset or shifted by half a tube width. According to the illustration two warp threads K are present in each tube of each of the two lamellae combs 2, 3. Thus, it will be seen that the two warp threads K in the tube B between two guide lamellae 5 are conjointly either in the upper shed position or in the lower shed position. In the tube C between two beat-up lamellae 4 one of the two warp threads K is in the upper shed position while the other one is in the lower shed position. Such representation corresponds to double stitch linen weaves.

The shed-retaining elements for the warp threads K are formed by laterally protruding projections or extensions provided at the guide lamellae 5. Each guide lamella 5 is provided with a first projection or extension 6 or 6', respectively, which serves as a shed-retaining element for the upper shed position and with a second projection or extension 7 or 7', respectively, which serves as a shed-retaining element for the lower or bottom shed position. The first projections 6, 6' are formed by a bent-over section located at an edge or marginal region of the guide lamellae 5. The second projections 7, 7' are formed by punching out a kind of approximately rectangular window or window wing at three edges from the guide lamellae 5 and by bending the same over at the fourth edge thereof. Since the shed-retaining elements for the upper and for the lower shed positions are always arranged in different tubes, the first and second projections 6, 6' and 7, 7', respectively, each protrude to different sides away from the guide lamellae 5.

Each shed-retaining element is formed by two first projections 6, 6′ or two second projections 7, 7′ which are formed at the guide lamellae 5 defining the respective tube. The two projections respectively forming one shed-retaining element project towards each other, as shown in FIGS. 2 and 3, and are mutually offset in the warp direction which roughly corresponds to the direction of the arrow II in FIG. 1. The lamellae comb 3 is thus composed of two kinds of guide lamellae 5: guide lamellae 5 having a first projection 6 extending opposite to the weft direction A and a second projection 7 extending in the weft direction A, and guide lamellae 5 having a first projection 6′ extending in the weft direction A and a second projection 7′ extending opposite to the weft direction A.

The construction of the shed-retaining elements in each case by two projections 6, 6′ or 7, 7′, respectively, which protrude towards each other and are mutually offset from one another enables a single lamellae set to be used for different tube widths. Therefore, the tube width is changed by displacing the guide lamellae 5 from a minimum distance at which the projections 6, 7 and 6′, 7′ of the one guide lamella 5 abut the adjacent guide lamella 5 with the respective free end face so that the projections show a maximum overlap to a maximum distance at which the aforementioned end faces are aligned or the projections 6, 7, 6′, 7′ are merely just still overlapping.

As shown, the carrier or support 1 for the lamellae combs 2 and 3 shown in FIG. 1 comprises two mutually parallel rails 8 and 9 which extend across the weaving or fabric width and one of which is provided with a dovetail 10. The dovetail 10 is intended to be inserted into a correspondingly configured slot or groove formed at the circumferential surface of the not particularly shown weaving rotor. The rail 8 carrying the dovetail 10 is provided along its length with distributively arranged threaded bores 11 spaced from one another by about 3 to 10 cm. Into each of these threaded bores 11 there is screwed a sunk screw 12, one end of which protrudes from the rail 8 and presses against the rail 9, as shown. By turning the screws 12 the distance between the two rails 8 and 9, and thus, the cross-section of the carrier or support 1 may be adjusted.

Each of the lamellae 4 and 5 has two mounting legs or limbs 13 and 14, respectively, which form a jaw or mouth 15 and 16, respectively, partially gripping around the mounting or support rails 8 and 9. The jaws 15 and 16 of the lamellae 4 and 5, respectively, are limited at the end of the respective mounting leg or limb 13 and 14 by a projection 17 and 18, respectively. The projections 17 and 18 are provided to lock into two diagonally oppositely situated edges provided at the two rails 8 and 9. The width of the jaws 15 and 16 and the cross-section of the rails 8, 9 are dimensioned such that with the screws or threaded bolts 12 released, i.e. at a small mutual distance of the two rails 8 and 9, the lamellae 4 and 5 including the mounting or attachment legs or limbs 13, 14 can be slipped onto the rails 8, 9 and thereafter can be fixed by appropriately adjusting or tightening the screws 12. The inner edge of the one mounting leg or limb 13 or 14 which extends perpendicularly with respect to the screws 12 has the same length as the corresponding dimension of the rail 9, and the inner edge of the other mounting leg or limb 13 or 14 which extends parallel to the screws 12 is longer than the sum of the corresponding dimensions of the two rails 8 and 9.

Each carrier or support 1 formed by the rails 8, 9 carries two lamellae combs 2 and 3 (see FIG. 1) containing beat-up lamellae 4 and guide lamellae 5, respectively, and these lamellae combs 2 and 3 are mutually displaced by half of a pitch or half a tube width B or C. The mounting or attachment legs or limbs 13 and 14 of the two types of lamellae 4 and 5 are oriented such that the mounting legs or limbs of the one type of lamellae which extend parallel to the screws 12 extend around one side wall of the rails 8, 9 while the same mounting limbs of the other type of lamellae extend around the other side wall of the rails 8, 9.

The lamellae combs 2, 3 are manufactured in such a manner that the individual lamellae 4 and 5 are mounted externally of the weaving loom upon a pair of rails 8, 9, the length of which corresponds to the length of the weaving rotor. During this operation the screws 12 are released to such an extent that the lamellae 4, 5 can be slipped on or mounted without any great effort. As will be evident from FIGS. 2 and 3, the beat-up lamellae 4 and the guide lamellae 5 are alternatingly mounted or slipped on, in the latter case there are alternatingly mounted guide lamellae 5 having the projections 6 and 7 and guide lamellae 5 having the projections 6′ and 7′.

As soon as the lamellae 4 and 5 are mounted onto the rails 8 and 9 at a length corresponding to about the space between two adjacent screws 12 the relevant screw 12 is tightened, whereby the lamellae 4 and 5 are firmly clamped to the rails 8, 9. In this manner the lamellae 4 and 5 can be consecutively mounted and the lamellae combs 2, 3 can be consecutively fixed in place.

Prior to fixing the lamellae 4, 5 the same have to be positioned on the rails 8, 9 while precisely maintaining their mutual distance, i.e. the tube width or the pitch. Positioning is done by using rod-like elements which are arranged parallel with respect to the carrier or support 1 and which are provided with guiding means or guides for the lamellae 4, 5, the pitch of the guiding means corresponding to the desired pitch of the lamellae 4, 5. Preferably, the positioning elements are formed by racks, the teeth of which have the desired pitch and a triangular or trapezoidal profile. These racks may be components of a gauge in which they are clamped conjointly with the carrier 1 such that the racks are in a position with respect to the carrier or support 1 in which the lamellae 4 and 5, after having been slipped onto the carrier 1 each just engage the associated rack with their upper outer edge as shown in FIG. 1. The thus positioned lamellae 4 and 5 can then be adhesively bonded or glued to the rails 8, 9 by a suitable adhesive to form an adhesive bond which can be released by the action of heat or a liquid. In case that the pitch of the lamellae combs 2, 3 is to be changed, then the adhesive bond may be dissolved by the action of heat or a solvent.

Another example of the rack arrangement is shown in the drawings, wherein the racks are embedded in the carrier or support 1. As shown in the drawings, the rail 9 is provided with two parallel longitudinal grooves or channels 19 and 20 at the outer surface or face thereof which is adjacent to the inner edge of the mounting leg or limb 13 or 14 which extends perpendicular to the screws 12. The rail 8 comprises respective longitudinal grooves or channels 21 and 22 in each of the two side surfaces or faces which extend parallel to the screws 12. Each of the grooves 19 to 22 is provided in order to accommodate a respective one of the racks 23 to 26 which extends over the entire length of the carrier or support 1, and thus, across the weaving or fabric width. A respective elastic insert or insert member, which in the illustrated example is constituted by an elastic or rubber cord 27 to 30 having a diameter of about 2 mm, is disposed between the bottom of each groove 19 to 22 and the associated rack 23 to 26.

A respective pair of racks 23, 26 and 24, 25 is provided for each lamellae comb 2 and 3, respectively (FIG. 1) and the lamellae 4 or 5, respectively, are each guided therein at the region of their projections 17 and 18, respectively. At the inner edge of the inner leg or limb which extends perpendicular to the screws 12 the lamellae 4, 5 each have a step or stepped portion 31 and 32, respectively, by means of which they extend from the exterior around the respective rack 24, 23 associated with the other lamella 5 or 4, whereby no contact can be made with the teeth thereof which project from the carrier 1 to the outside.

The depth of the grooves 19 to 22, the height of the racks 23 to 26 and the height of the teeth thereof as well as the thickness of the elastic or rubber cords 27 to 30 are matched to each other such that the teeth of the racks 23 to 26 prior to mounting of the lamellae 4, 5 onto the carrier 1 slightly protrude past the side surfaces or faces of the rails 8 and 9 which are provided with the grooves 19 to 22. Thus, the lamellae 4, 5 are slipped on or mounted against the pressure of the elastic or rubber cords 27 to 30 which press the teeth of the racks 23 to 26 completely against and between the lamellae 4 and 5, which are thus always positively positioned.

By virtue of the racks 23 to 26 extending across the entire weaving or fabric width, the lamellae 4, 5 are positioned without any sum or summation error, i.e. defective effects due to deviations in the thickness or planarity or flatness of the lamellae 4, 5 cannot be summed up or added. Merely an error in the machine tool by means of which the teeth have been produced could have an effect. This, however, is highly improbable, on the one hand, and furthermore without effect, on the other hand, since such error would be identical in all racks 23 to 26 of one manufacturing batch or lot.

In case that the tube width is to be changed due to a change in the article to be woven, there is only required an exchange of the racks 23 to 26. Due to the mutually overlapping projections 6, 6' and 7, 7' the lamellae 5 containing the shed-retaining elements can be adapted to the new tube width within wide limits and the beat-up lamellae 4, also, only have to be positioned anew. It will be self-evident that the projections 6, 6', 7, 7' do not necessarily have to be mutually offset in the warp direction, but also may be offset in a radial direction with respect to the weaving rotor. In such case the projections 6, 6' or 7, 7' would be located above one another.

While there are shown and described present preferred embodiments of the invention, it is to be distinctly understood that the invention is not limited thereto, but may be otherwise variously embodied and practiced within the scope of the following claims.

Accordingly, what I claim is:

1. A lamellae comb for weaving machines, particularly for a weaving rotor of a multiple longitudinal traversing shed weaving machine, comprising:

a plurality of lamellae;

a carrier on which said lamellae are arranged;

shed-retaining elements for retaining warp threads;

each one of said shed-retaining elements comprising two lateral projections extending from two of said lamellae which enclose said shed-retaining element;

said projections including warp thread bearing surfaces lying in the same plane; and said projections protruding towards each other, conjointly bridging an intermediate space between said two lamellae and being offset from one another in a predetermined direction of extent of the warp threads.

2. The lamellae comb as defined in claim 1, wherein:

said projections contain free end faces defining overlapping lines of alignment.

3. The lamellae comb as defined in claim 2, wherein:

at least predetermined ones of said projections define an approximately rectangular window folded out from its related lamella; and said window being punched out from said lamella at three of its sides and being bent-over therefrom at a fourth side thereof.

4. The lamellae comb as defined in claim 1, wherein:

the lamellae are arranged in spaced relation from one another at a predetermined pitch;

a positioning element arranged on said carrier of said lamellae;

guiding means for said lamellae provided at said positioning element; and said guiding means having a pitch essentially corresponding to the pitch of said lamellae.

5. The lamellae comb as defined in claim 4, wherein:

said carrier comprises two parallel rails extending over a weaving width of the loom;

said positioning element comprising a rod extending over said weaving width; and said rod being supported at one of said rails and having groove-like guides defining said guiding means.

6. The lamellae comb as defined in claim 5, wherein:

said rod comprises a rack containing teeth which extend transversely with respect to a longitudinal direction thereof; and said teeth forming said guiding means and being engageable with said lamellae.

7. The lamellae comb as defined in claim 6, further including:

a mounting member formed at each said lamellae; and means for elastically pressing said teeth of said rack against said mounting member of said lamellae.

8. The lamellae comb as defined in claim 7, further including:

a longitudinal groove having a bottom formed in at least said one rail;

said longitudinal groove supporting said rack, the teeth of which protrude from said one rail in a rest position thereof; and said elastically pressing means comprising an elastic cord arranged between said bottom of the groove and said rack.

9. The lamellae comb as defined in claim 8, further including:

two substantially jaw-like mounting limbs extending substantially at right angles to each other formed at each said lamella for gripping around said carrier;

said carrier having a substantially rectangular cross-section;

a pair of said racks provided at each said rail; and each said rack of said pair engaging with a respective one of said mounting limbs on said lamellae.

10. The lamellae comb as defined in claim 9, wherein:
said two rails engage with said mounting limbs at the region of respective ends of said mounting limbs; and
said mounting limbs are arranged substantially diagonally opposite each other at said carrier.

11. The lamellae comb as defined in claim 10, further including:
two series of mutually offset rows of said lamellae;
one of said series being provided with shed-retaining elements for said warp threads and the other one of said series serving as a beat-up means for said weft threads;
one pair of said racks provided for each said series;
said pairs of said racks with their respective teeth being displaced from each other in correspondence to said mutual offset of said two series of said lamellae; and
each of said two pairs being arranged opposite each other at each one of two diagonals of said carrier.

12. A method of manufacturing a lamellae comb containing lamellae for a weaving machine, particularly for a weaving rotor in a multiple longitudinal traversing shed weaving machine, containing a carrier for said lamellae, said method comprising the steps of:
mounting said lamellae at said carrier;
positioning said lamellae on said carrier at a desired pitch using a positioning element arranged substantially in parallelism with respect to said carrier and having guide means for said lamellae, the pitch of which essentially corresponds to said desired pitch; and
fixing said lamellae to said carrier.

13. The method as defined in claim 12, wherein:
said lamellae are mounted in respective rows at said carrier;
using as the positioning element a rack extending over a predetermined weaving width of the weaving machine and having teeth defining said guide means for positioning said lamellae of each row thereof;
guiding said lamellae in said teeth; and
elastically pressing said rack with said teeth thereof against edges of said lamellae.

14. The method as defined in claim 13, further including the steps of:
mounting said carrier in an assembly stand; and
anchoring said rack in said assembly stand such that said rack engages with an outer edge of said lamellae remote from said carrier.

15. The method as defined in claim 14, further including the steps of:
positionally fixing said lamellae to said carrier in a position determined by said rack by using a fixing agent which is releaseable by the action of either heat or a solvent; and
removing said rack after fixing said lamellae.

16. The method as defined in claim 13, further including the steps of:
supporting said rack at said carrier such that said rack engages with an inner edge of the lamellae abutting said carrier.

17. The method as defined in claim 16, further including the steps of:
fixing said lamellae to said carrier by adjusting the cross-section thereof; and
leaving said racks in their position at said carrier after said lamellae have been fixed at said carrier, and said racks further engaging with said lamellae in said position of the racks.

18. A lamellae comb for weaving machines, particularly for a weaving rotor of a multiple longitudinal traversing shed weaving machine, comprising:
a plurality of lamellae;
a carrier on which said lamellae are arranged;
shed-retaining elements for retaining warp threads;
each said shed-retaining element comprising two lateral projections extending from two of said lamellae which enclose said shed-retaining element; and
said projections protruding towards each other, conjointly bridging an intermediate space bounded by said two lamellae and being mutually offset from one another in a predetermined direction of extent of the warp threads.

19. A lamellae comb for weaving machines, particularly for a weaving rotor of a multiple longitudinal traversing shed weaving machine, comprising:
a plurality of lamellae;
a carrier on which said lamellae are arranged;
each one of the lamellae of said plurality of lamellae comprising two lateral projections which extend from opposite sides of said lamellae;
said plurality of lamellae being arranged at said carrier in pairs of two adjacent lamellae; and
each said pair of two adjacent lamellae comprising one pair of one of said two lateral projections which protrude towards each other and are arranged in offset relationship from each other and which define at least one of an upper shed-retaining element or a lower shed-retaining retaining element for retaining warp threads.

20. The lamellae comb as defined in claim 19, wherein:
said two lateral projections extending from each one of said pairs of two adjacent lamellae are offset from each other in a predetermined direction of extent of the warp threads.

* * * * *